US008322039B2

(12) United States Patent
De Buyer-Mimeure

(10) Patent No.: US 8,322,039 B2
(45) Date of Patent: Dec. 4, 2012

(54) KNIFE AND DEVICE ASSEMBLY

(75) Inventor: Edouard De Buyer-Mimeure, Bourges (FR)

(73) Assignee: Wildsteer, Bourges (FR)

( * ) Notice: Subject to any disclaimer, the term of this patent is extended or adjusted under 35 U.S.C. 154(b) by 428 days.

(21) Appl. No.: 12/695,527

(22) Filed: Jan. 28, 2010

(65) Prior Publication Data

US 2010/0192380 A1 Aug. 5, 2010

(30) Foreign Application Priority Data

Feb. 4, 2009 (FR) ..... 09 50677

(51) Int. Cl.
*B26B 11/00* (2006.01)

(52) U.S. Cl. ..... 30/123; 30/146; 7/118; 7/158

(58) Field of Classification Search ..... 30/122, 30/123, 136, 142, 143, 145, 146, 155, 158, 30/159; 7/118, 119, 125, 131, 132, 134, 7/158; 86/22; 42/90
See application file for complete search history.

(56) References Cited

U.S. PATENT DOCUMENTS

| | | | | | |
|---|---|---|---|---|---|
| 26,061 | A | * | 11/1859 | Sykes | 30/146 |
| 102,617 | A | * | 5/1870 | Taft | 30/142 |
| 160,392 | A | * | 3/1875 | Chase | 30/146 |
| 297,375 | A | * | 4/1884 | Freund | 30/155 |
| 313,414 | A | * | 3/1885 | Freund | 30/161 |
| 318,006 | A | * | 5/1885 | Martin | 30/123 |
| 580,235 | A | * | 4/1897 | Strum | 30/123 |
| 594,984 | A | * | 12/1897 | Chapman | 30/155 |
| 614,537 | A | * | 11/1898 | Dahlquist et al. | 30/123 |
| 632,590 | A | * | 9/1899 | Shelton | 30/146 |
| 632,792 | A | * | 9/1899 | Schmidt | 30/152 |
| 822,441 | A | * | 6/1906 | Forbes | 30/146 |
| 826,569 | A | * | 7/1906 | Hanson | 30/146 |
| 857,459 | A | * | 6/1907 | Hendrickson | 30/146 |
| 896,746 | A | * | 8/1908 | McCarty | 30/146 |
| 979,686 | A | * | 12/1910 | Nelson et al. | 30/142 |

(Continued)

FOREIGN PATENT DOCUMENTS

DE 3644761 A1 7/1988

(Continued)

OTHER PUBLICATIONS

International Search Report for FR 0950677 dated Sep. 2, 2009.

*Primary Examiner* — Jason Daniel Prone
(74) *Attorney, Agent, or Firm* — Heslin Rothenberg Farley & Mesiti P.C.

(57) ABSTRACT

A knife and device assembly includes a knife with a blade part and a handle part having on the blade part, near the handle part, a hook shaped part with an interior recess, in combination with a device comprising an extended handle. A front end of the handle has both a pin for engaging with and pivoting in the hook shaped part of the blade part, and a cutting element to cut metal wires and the like. The handle fulfills the function of cutting pliers with the handle part of the knife. The front end of the handle has a fork shape with two wings braced by the pin. The cutting element is received in a space formed between the wings, the pin and a bottom of the fork shape, and has a cutting part projecting beyond the handle.

8 Claims, 2 Drawing Sheets

U.S. PATENT DOCUMENTS

| | | | | | |
|---|---|---|---|---|---|
| 1,007,605 | A | * | 10/1911 | Raudebaugh | 30/146 |
| 1,121,289 | A | * | 12/1914 | Robertson | 30/155 |
| 1,184,746 | A | * | 5/1916 | Hanson | 30/155 |
| 1,194,486 | A | * | 8/1916 | Downs | 30/146 |
| 1,253,627 | A | * | 1/1918 | O'Neill | 30/146 |
| 1,260,723 | A | * | 3/1918 | Skwarek | 30/142 |
| 1,268,172 | A | * | 6/1918 | Stanislawaki | 30/146 |
| 1,269,790 | A | * | 6/1918 | Danhoffeh | 30/146 |
| 1,274,194 | A | * | 7/1918 | Pirog | 30/146 |
| 1,277,031 | A | * | 8/1918 | Bigos | 30/146 |
| 1,277,521 | A | * | 9/1918 | Worek | 30/146 |
| 1,280,398 | A | * | 10/1918 | Ciolkosz | 30/146 |
| 1,282,903 | A | * | 10/1918 | Maziarz | 30/146 |
| 1,283,824 | A | * | 11/1918 | Lewandowski | 30/146 |
| 1,285,681 | A | * | 11/1918 | Gora | 30/146 |
| 1,287,569 | A | * | 12/1918 | Bizon | 30/146 |
| 1,289,159 | A | * | 12/1918 | Gramza | 30/146 |
| 1,297,571 | A | * | 3/1919 | Kaczmaryk | 30/146 |
| 1,298,166 | A | * | 3/1919 | Borszcz | 30/146 |
| 1,303,277 | A | * | 5/1919 | Federkiewicz | 30/146 |
| 1,342,382 | A | * | 6/1920 | Hmirak | 30/144 |
| 1,423,791 | A | * | 7/1922 | Francisco | 30/146 |
| 1,561,993 | A | * | 11/1925 | Nielsen | 7/118 |
| 1,771,031 | A | * | 7/1930 | Court | 30/146 |
| 1,935,149 | A | * | 11/1933 | Elvin | 30/123 |
| 2,182,710 | A | * | 12/1939 | Tamke | 30/155 |
| 2,674,796 | A | * | 4/1954 | Herold | 30/146 |
| 3,835,533 | A | * | 9/1974 | Granson | 30/146 |
| 3,842,458 | A | * | 10/1974 | Bauer | 7/158 |
| 3,846,908 | A | | 11/1974 | Allievi | |
| 4,247,984 | A | * | 2/1981 | McArdle et al. | 30/231 |
| 4,720,030 | A | * | 1/1988 | Petrovich | 30/142 |
| 5,226,237 | A | * | 7/1993 | Rancour et al. | 7/158 |
| 5,255,438 | A | | 10/1993 | Morgan | |
| 5,625,951 | A | * | 5/1997 | Hamlin | 30/146 |
| D382,459 | S | * | 8/1997 | Khalsa | D8/99 |
| 6,009,583 | A | * | 1/2000 | Swanstrom, Jr. | 30/145 |
| 6,698,099 | B2 | * | 3/2004 | Ronan et al. | 30/146 |
| 6,877,229 | B2 | * | 4/2005 | Sakai | 30/146 |
| 7,036,228 | B2 | * | 5/2006 | Chen | 30/146 |
| 7,080,455 | B1 | * | 7/2006 | Ronan et al. | 30/146 |
| D602,328 | S | * | 10/2009 | Medhurst | D8/105 |
| 7,682,270 | B2 | * | 3/2010 | De Buyer-Mimeure | 30/123 |
| 7,918,148 | B2 | * | 4/2011 | Lin | 30/90.6 |
| 8,109,002 | B2 | * | 2/2012 | Frazer | 30/123 |
| 2003/0101590 | A1 | * | 6/2003 | Ronan et al. | 30/146 |
| 2003/0208910 | A1 | * | 11/2003 | Dudley et al. | 30/142 |
| 2008/0110029 | A1 | * | 5/2008 | Ryan et al. | 30/155 |

FOREIGN PATENT DOCUMENTS

| | | | | |
|---|---|---|---|---|
| DE | 3715440 | A1 | | 11/1988 |
| DE | 9315843 | U1 | | 2/1994 |
| DE | 20108530 | U1 | | 10/2001 |
| EP | 2079137 | A1 | * | 7/2009 |
| EP | 2216146 | A1 | * | 8/2010 |
| WO | WO 2005118234 | A1 | * | 12/2005 |

* cited by examiner

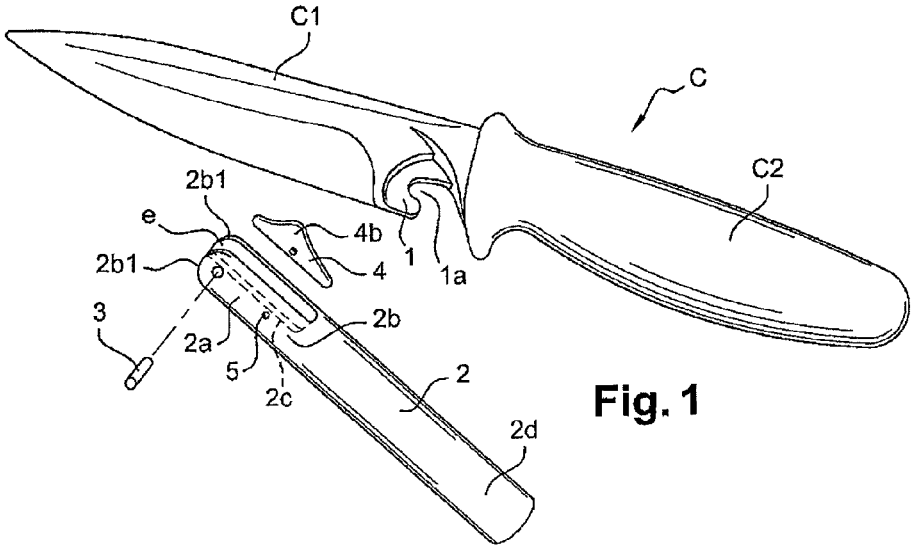
Fig. 1
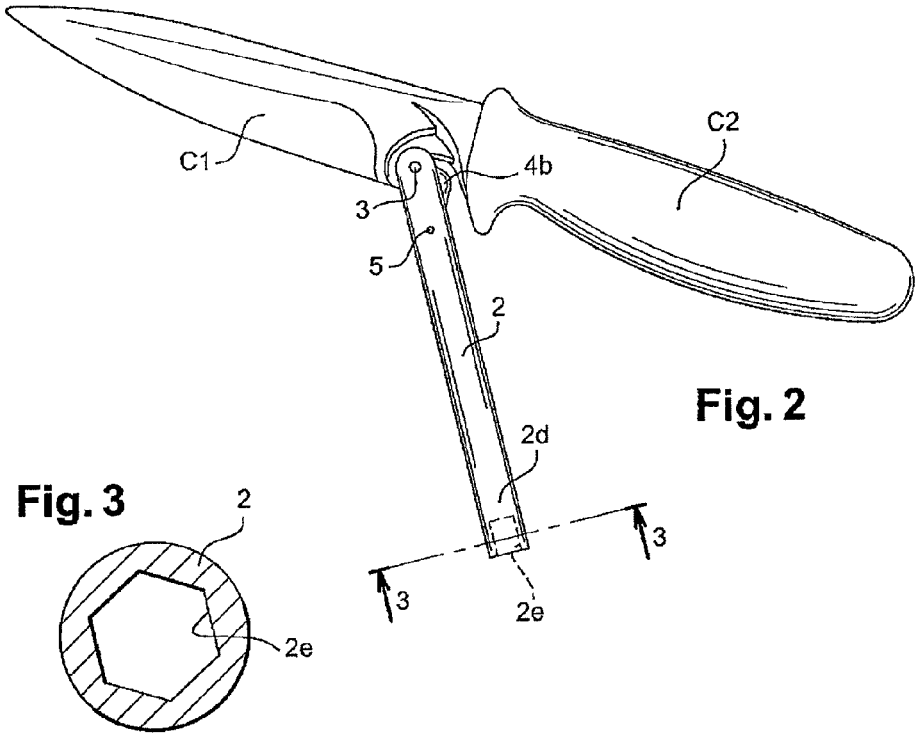
Fig. 2
Fig. 3

KNIFE AND DEVICE ASSEMBLY

CROSS REFERENCE TO RELATED APPLICATIONS

This application claims priority of French application FR 0950677 filed on Feb. 4, 2009, the entire contents of which is hereby incorporated by reference herein.

BACKGROUND ART

This invention relates to the technical sector of cutlery, and more particularly to multi-function knives.

Known for a long time, these types of knives are based on a single body designed to receive different types of blades and/or accessories such as scissors and corkscrews, offering the user a multiplicity of functions. The typical example is that of the knife known by the commercial name of "Swiss Army Knife" which may be larger or smaller depending on the number of accessories or blades stored.

This type of knife is generally used when trekking, camping and, in certain cases, in survival situations.

The functions are nevertheless limited, because the necessarily limited storage space of the body of the knife must be taken into account, otherwise the body would be excessively bulky and heavy.

In the case of certain variations, some so-called "Swiss Army Knives" are even designed in the form of pliers having in the branches of the handle specific arrangements to receive multi-function tools in the form of blades, scissors and suchlike.

Furthermore, and to the knowledge of the Applicant, some functions are not provided and possible on this type of knife, for example the cutting of metal wires that may be several millimeters in diameter. This scissor part known on so-called "Swiss Army Knives" is limited in its capacity to cut and/or shear.

Document US 2003/0101590 discloses a knife of complicated design that transforms into cutting pliers.

Other devices of the same type described in patents DE 9315843 and DE 3715440 are also known.

The Applicant's approach has therefore been to devise a new design of knife unlike the so-called "Swiss Army Knives" to fulfil new functions and be used as a proper hand tool.

The solution proposed by the Applicant is simple, inexpensive, has no impact on the configuration of the knife and its volume.

BRIEF SUMMARY OF THE INVENTION

According to a first characteristic of the invention, the knife and device assembly includes a knife with a blade part and a handle part having on the blade part, near the handle part, a hook shaped part with a deep bottom part (interior recess), in combination with a device comprising an extended handle whose front end has both an articulation pin for engaging with and pivoting in the interior recess of the hook part of the blade part, and a cutting element to cut metal wires and the like. The handle with the cutting element and the handle part of the knife fulfill the function of cutting pliers. The front end of the handle has a fork shape with two wings braced by the articulation pin. A space formed between the wings, the pin and the bottom of the fork shape receives the cutting element. The cutting element has a cutting part projecting beyond the handle.

These and other characteristics will emerge more clearly from the following description.

BRIEF DESCRIPTION OF THE DRAWING FIGURES

The object of the invention is illustrated in a non-limiting way in the accompanying drawings, in which:

FIG. 1 is a perspective view before assembly of the knife and the device according to the invention.

FIG. 2 is a view of the knife with the device fitted.

FIG. 3 is a sectional view along line 3-3 in FIG. 2.

DETAILED DESCRIPTION

Figure 4:
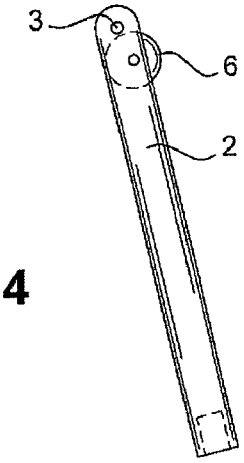
FIG. 4 is a variation of the device according to the invention.

For a better understanding of the object of the invention, a non-limiting description thereof now follows, as illustrated in the figures.

The knife including the device according to the invention is designated as a whole by the reference (C) and comprises a blade part (C1) and a handle part (C2). To enable the implementation of the invention, the blade part, near the handle part, has a curved hook shaped part (1) with a deep bottom part or interior recess (1*a*). The device according to the invention is numbered (2) and comprises a very long or extended handle. One end (2*a*) of the extended handle is designed to receive a pin (3) capable of engaging with and pivoting in the interior recess of the hook part of the blade and to receive a cutting element (4) designed to cut metal wires (F) and the like positioned between the extended handle and the handle part of the knife. The handle with the cutting element fulfills the function of cutting pliers with the handle part of the knife itself.

With reference to the drawings, the very long handle (2) has a fork shape (2*b*) at its front end (2*a*) with two wings (2*b*1) braced by the articulation pin (3). The space (e) formed between the wings (2*b*1), the pin (3) and the bottom of the fork shape enables the cuttings element (4) to be received. The latter may be arranged as shown in FIG. 1 by a piece shaped like a tricorn with a cutting part (4*b*) that protrudes and can therefore be sharpened as required. This piece is secured by a rivet (5) between the wings (2*b*1) of the fork shape (2*b*). It is advantageously supported by a mounting (2*c*) which constitutes a counter-brace to absorb the cutting forces.

The cutting piece (4) may be fitted in a fixed or removable manner. In the variation shown in FIG. 4, the cutting piece is made in the form of a cutting wheel (6).

Figure 5:
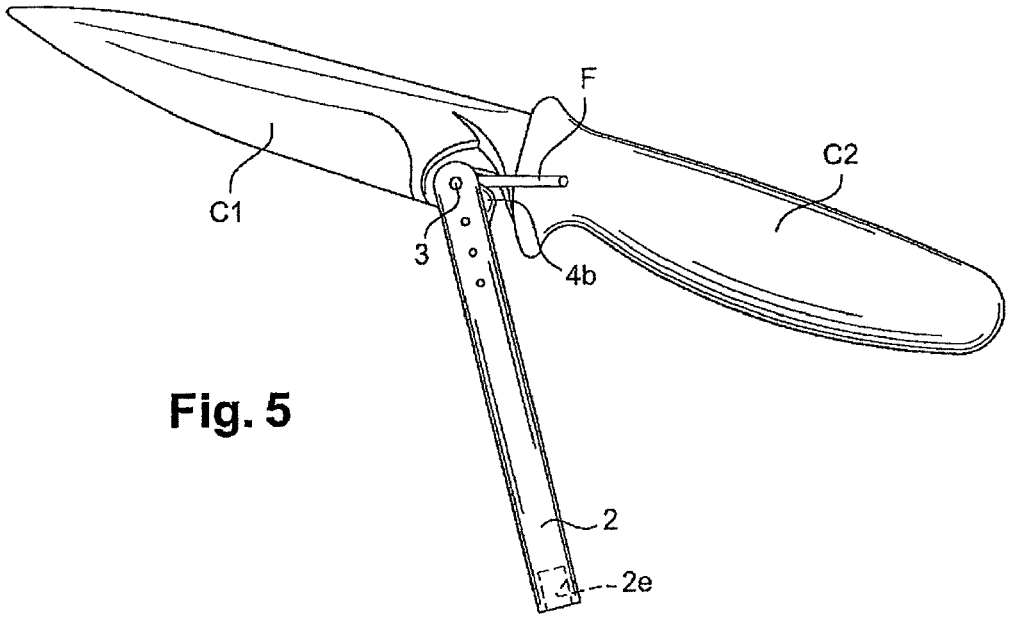
FIG. 5 shows the use of the knife and the associated device for cutting wires.

With reference to FIG. 5, the articulation of the handle (2) in relation to the handle part (C2) of the knife will enable wire-shaped elements like metal wires (F) or the like to be held and cut.

According to another embodiment of the invention, the other end (2*d*) of the handle (2) may be designed internally so as to have a useful shape, such as a thread or threaded portion, or to have a polygon shape (2*e*) to enable the knife to be used as a screwing or unscrewing tool. The polygon shape is suitable for receiving similarly shaped tool modules.

The advantages of the invention are clear. Emphasis is given to the practical aspect of the knife and its device, the easy storage facilities that it offers and the possibility of using the knife as a screwing/unscrewing hand tool, a screwdriver or other tool.

Furthermore, and compared to the prior art of so-called "Swiss Army Knives", the invention enables metal wires to be cut with a much greater pressure force, cutting wires of several millimeters in diameter.

The invention claimed is:

1. Knife and device assembly comprising a knife with a blade part and a handle part, the blade part having a hook shaped part defining an interior recess adjacent the handle part, in combination with a device comprising an extended handle, a front end of the extended handle defining two spaced wings, an articulation pin extending in-between the wings, wherein the articulation pin engages with and pivots in the interior recess of the hook shaped part of the blade part, a cutting element with a cutting part received in-between the wings of the extended handle and positioned so that the cutting part projects beyond the extended handle and when the articulation pin is received in the interior recess, the cutting element is closer to the handle part of the knife than the articulation pin, and wherein when the articulation pin is received in the interior recess the extended handle with the cutting element together with the handle part of the knife function as cutting pliers.

2. The knife and device assembly according to claim 1, wherein the cutting element is a tricorn-shaped piece having three projections, one of the projections defining the cutting part that protrudes beyond the extended handle and therefore can be sharpened.

3. The knife and device assembly according to claim 2, wherein the tricorn-shaped piece is secured in-between the wings by a rivet.

4. The knife and device assembly according to claim 1, wherein the front end of the extended handle includes a counter-brace wall in-between the wings to support the cutting element and to absorb cutting forces.

5. The knife and device assembly according to claim 1, wherein the cutting element is a cutting wheel.

6. The knife and device assembly according to claim 1, wherein another end of the extended handle incorporates a threaded internal portion.

7. The knife and device assembly according to claim 1, wherein another end of the extended handle incorporates an internal portion having a polygon shape enabling the extended handle to perform a screwing and/or unscrewing function.

8. The knife and device assembly according to claim 1, wherein, when functioning as the cutting pliers, the extended handle is connected to the knife only by the articulation pin.

* * * * *